US006641031B2

(12) United States Patent
Evans et al.

(10) Patent No.: US 6,641,031 B2
(45) Date of Patent: Nov. 4, 2003

(54) CHILD RESISTANT CARTON AND METHOD FOR USING THE SAME

(75) Inventors: James Ivor Evans, New Haven, CT (US); Carl W. Treleaven, Greensboro, NC (US)

(73) Assignee: Pharmagraphics, Inc., Portland, CT (US)

( * ) Notice: Subject to any disclaimer, the term of this patent is extended or adjusted under 35 U.S.C. 154(b) by 0 days.

(21) Appl. No.: 10/314,587

(22) Filed: Dec. 9, 2002

(65) Prior Publication Data

US 2003/0085262 A1 May 8, 2003

Related U.S. Application Data

(63) Continuation of application No. 09/922,596, filed on Aug. 3, 2001, now Pat. No. 6,491,211.

(51) Int. Cl.[7] ..... B65D 5/38; B65D 5/43

(52) U.S. Cl. ..... 229/102; 206/532; 206/807; 229/125.125

(58) Field of Search ..... 229/102, 125.125, 229/913, 8, 281, 345.2, 345.4, 351; 206/1.5, 528, 532, 807

(56) References Cited

U.S. PATENT DOCUMENTS

| | | | | |
|---|---|---|---|---|
| 1,253,489 | A | 1/1918 | Houghland | 229/125.125 |
| 2,426,856 | A | 9/1947 | Berg | 229/125.125 |
| 2,686,627 | A | 8/1954 | McElwee | 229/125.125 |
| 3,215,332 | A | 11/1965 | Bess | 229/19 |
| 3,648,918 | A | 3/1972 | Van Inwagen | 229/125.125 |
| 3,761,009 | A | 9/1973 | Rosenburg, Jr. | 229/125.125 |
| 3,761,010 | A | 9/1973 | Rosenburg, Jr. | 206/1.5 |
| 3,888,350 | A | 6/1975 | Horvath | 206/531 |
| 3,987,891 | A | 10/1976 | Horvath | 206/1.5 |
| 4,007,828 | A | 2/1977 | Mayled | 206/1.5 |
| 4,076,117 | A | 2/1978 | Wisdom et al. | 220/345.4 |
| 4,113,098 | A | 9/1978 | Howard | 206/540 |
| 4,192,422 | A | 3/1980 | Kotyuk | 206/528 |
| 4,364,488 | A | 12/1982 | Anjou | 220/281 |
| 4,401,210 | A | 8/1983 | Anjou | 206/1.5 |
| 4,485,915 | A | 12/1984 | Berghahn | 220/281 |
| 4,524,901 | A | 6/1985 | Tikka | 229/125.125 |
| 4,561,544 | A | 12/1985 | Reeve | 206/807 |
| 4,817,819 | A | 4/1989 | Kelly | 221/2 |
| 4,940,016 | A | 7/1990 | Heath | 119/1 |
| 5,088,599 | A | 2/1992 | Mahler | 229/125.125 |
| 5,150,793 | A | 9/1992 | Tannenbaum | 206/531 |
| 5,244,091 | A | 9/1993 | Tannenbaum | 206/462 |
| 5,275,291 | A | 1/1994 | Sledge | 206/531 |
| 5,402,888 | A | 4/1995 | Marie | 206/426 |
| 5,480,249 | A | 1/1996 | Kageyama et al. | 220/351 |
| 5,582,344 | A | 12/1996 | Lawson et al. | 229/217 |
| RE35,445 | E | 2/1997 | Pora | 206/532 |
| 5,732,822 | A | 3/1998 | Mitsuyama | 206/387.11 |
| 6,047,829 | A | 4/2000 | Johnstone et al. | 206/531 |
| 6,230,893 | B1 | 5/2001 | Karow | 206/531 |
| 6,491,211 | B1 * | 12/2002 | Evans et al. | 229/102 |

FOREIGN PATENT DOCUMENTS

| | | | |
|---|---|---|---|
| GB | 2042476 | 9/1980 | 220/8 |
| WO | WO 97/38919 | 10/1997 | B65D/85/57 |

* cited by examiner

*Primary Examiner*—Gary E. Elkins
(74) *Attorney, Agent, or Firm*—Myers Bigel Sibley & Sajovec

(57) ABSTRACT

A child resistant carton assembly includes a carton including a body panel. A locking panel is spaced apart from the body panel. The locking panel and the body panel define a locking chamber therebetween. A tray is slidably mounted in the carton. The tray includes a locking tab adapted to releasably engage the locking panel such that at least an insert portion of the locking tab is disposed in the locking chamber. A method is provided for using a child resistant carton including a carton and a tray slidably mounted in the carton. The carton includes a body panel and a locking panel spaced apart from one another and defining a locking chamber therebetween. The tray includes a locking tab. The method includes inserting at least an insert portion of the locking tab into the locking chamber to resist withdrawal of the tray from the carton, and displacing the locking tab from the locking chamber to release the tray.

19 Claims, 11 Drawing Sheets

CHILD RESISTANT CARTON AND METHOD FOR USING THE SAME

CLAIM FOR PRIORITY AND CROSS-REFERENCE TO OTHER APPLICATIONS

This application claims priority to and is a continuation of parent application Ser. No. 09/922,596 filed Aug. 3, 2001, now U.S. Pat. No. 6,491,211, the disclosure of which is hereby incorporated herein by reference.

FIELD OF THE INVENTION

The present invention relates to cartons, and, more particularly, to child resistant cartons and methods for using the same.

BACKGROUND OF THE INVENTION

Cartons may be employed to package pharmaceutical tablets and the like. Often times, it is desirable or necessary to prevent or resist access of children to the contents of such packages. Accordingly, it is desirable to provide one or more child resistant features. The child resistant features should be durable and reliable, but nonetheless easily operated by adults. Preferably, the carton may be operated to repeatedly access the contents thereof.

SUMMARY OF THE INVENTION

According to embodiments of the present invention, a child resistant carton assembly includes a carton including a body panel. A locking panel is spaced apart from the body panel. The locking panel and the body panel define a locking chamber therebetween. A tray is slidably mounted in the carton. The tray includes a locking tab adapted to releasably engage the locking panel such that at least an insert portion of the locking tab is disposed in the locking chamber.

According to method embodiments of the present invention, a method is provided for using a child resistant carton including a carton and a tray slidably mounted in the carton. The carton includes a body panel and a locking panel spaced apart from one another and defining a locking chamber therebetween. The tray includes a locking tab. The method includes inserting at least an insert portion of the locking tab into the locking chamber to resist withdrawal of the tray from the carton, and displacing the locking tab from the locking chamber to release the tray.

Objects of the present invention will be appreciated by those of ordinary skill in the art from a reading of the figures and the detailed description of the preferred embodiments which follow, such description being merely illustrative of the present invention.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present. "Upper," "lower" and like terms as used herein refer to relative positions of components. However, it will be appreciated that cartons according to the invention may be oriented such that the relative positions of the components are reversed or are horizontally rather than vertically aligned, in which case it will be understood that "upper," "lower" and the like describe the relative positions of the components along a selected axis (which may or may not be fully or partially vertically oriented).

Figure 1:
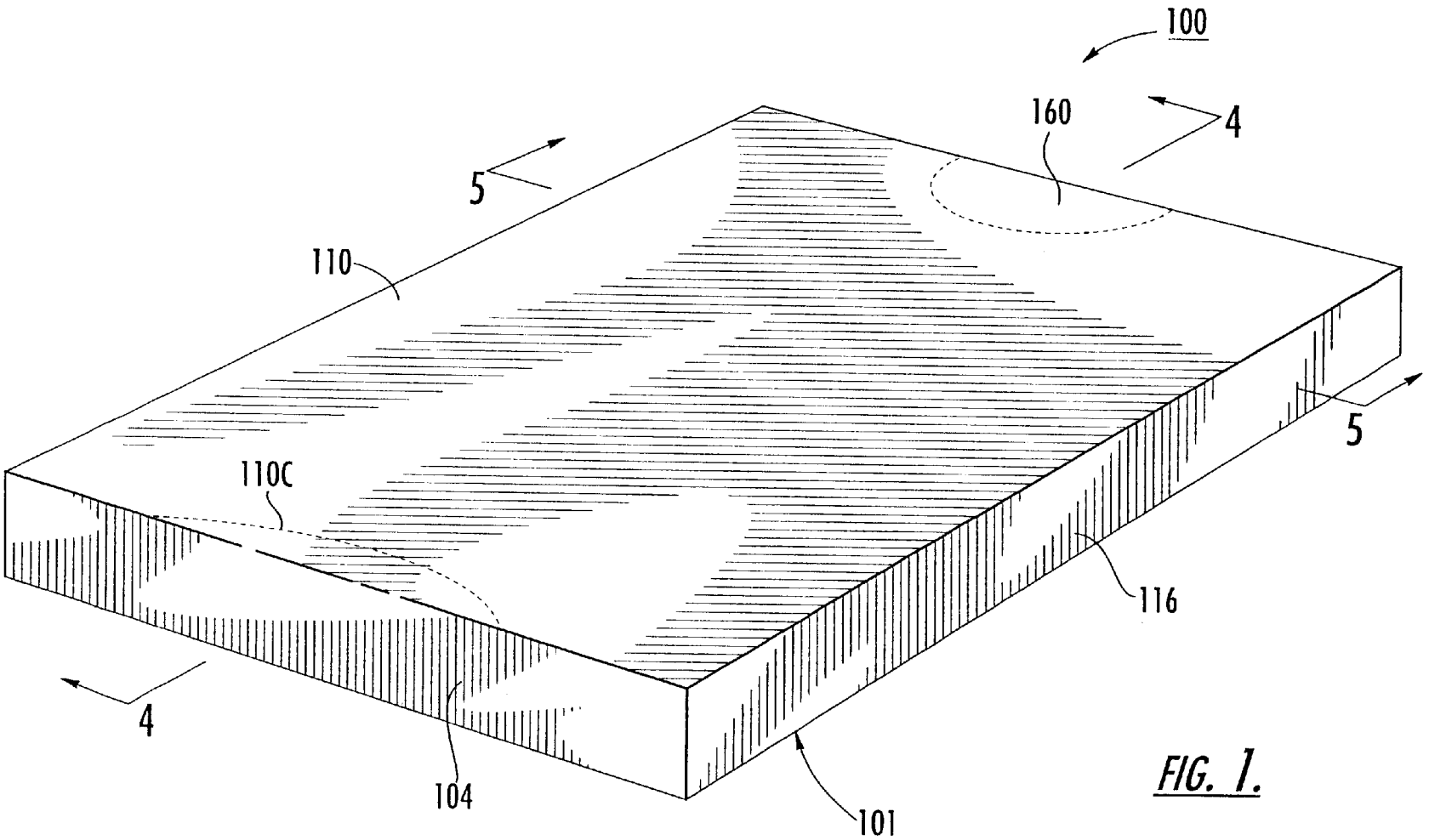
FIG. 1 is a perspective view of a child resistant carton assembly according to embodiments of the present invention wherein the carton assembly is in a closed position.
Figure 2:
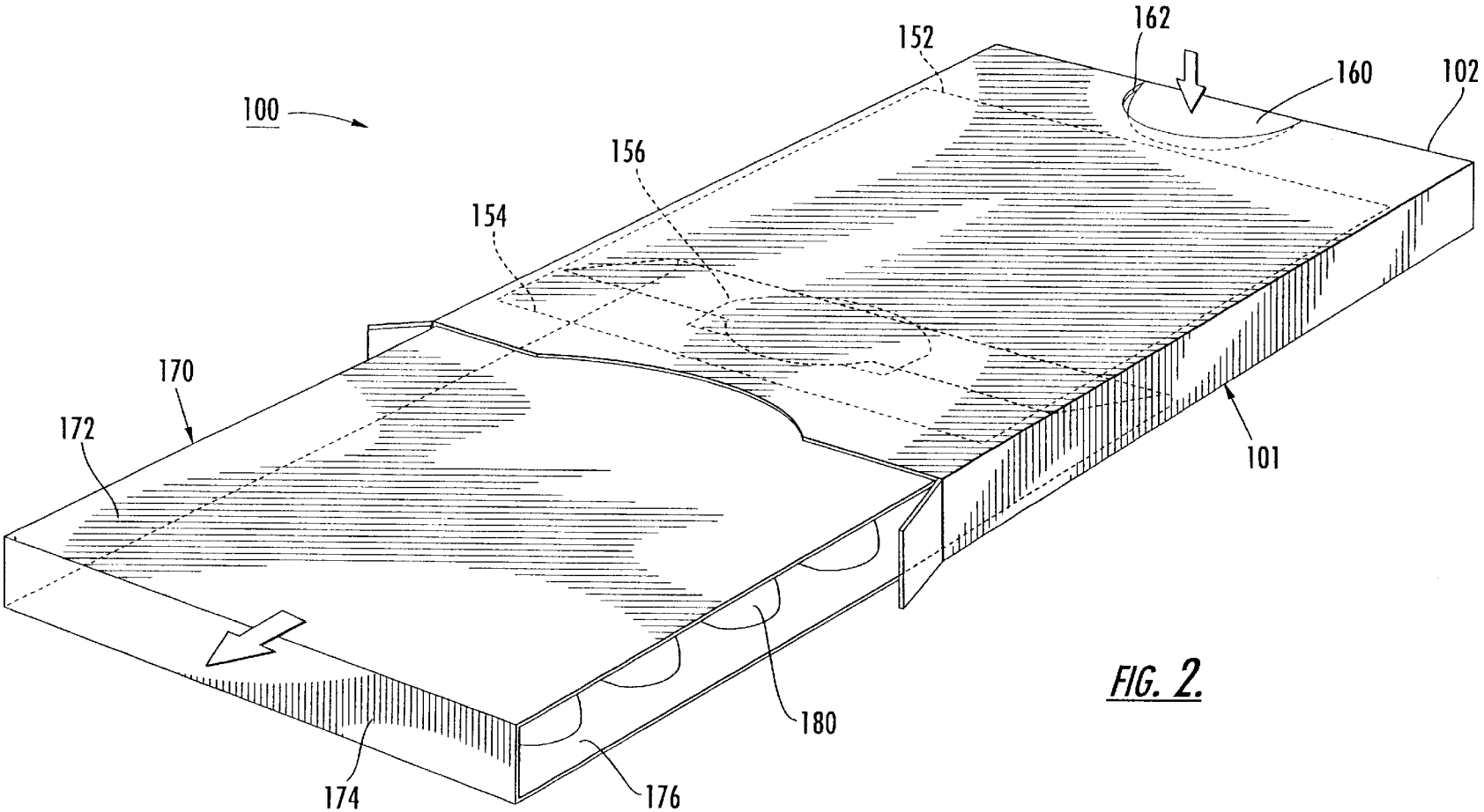
FIG. 2 is a perspective view of the carton assembly of FIG. 1 wherein a tray forming a part thereof is partially withdrawn from a carton forming a part of the carton assembly.

With reference to FIGS. 1 and 2, a child resistant carton assembly 100 according to embodiments of the present invention is shown therein. The assembly 100 has a rear end 102 and a front end 104 and includes generally a carton 101 and a tray 170. The tray 170 may hold, for example, a plurality of pharmaceutical tablets 184 or the like. The carton assembly 100 may be transitioned from a closed configuration as shown in FIG. 1 to an open configuration as shown in FIG. 2. The assembly 100 is adapted such that a user must execute certain releasing steps to unlock the tray 170 from a stored position in the carton 101 to allow the tray 170 to be pulled out from the carton 101 and into an open or fully extended position. These releasing steps are adapted to resist attempts by a child to access the tray 170 and its contents.

Figure 3:
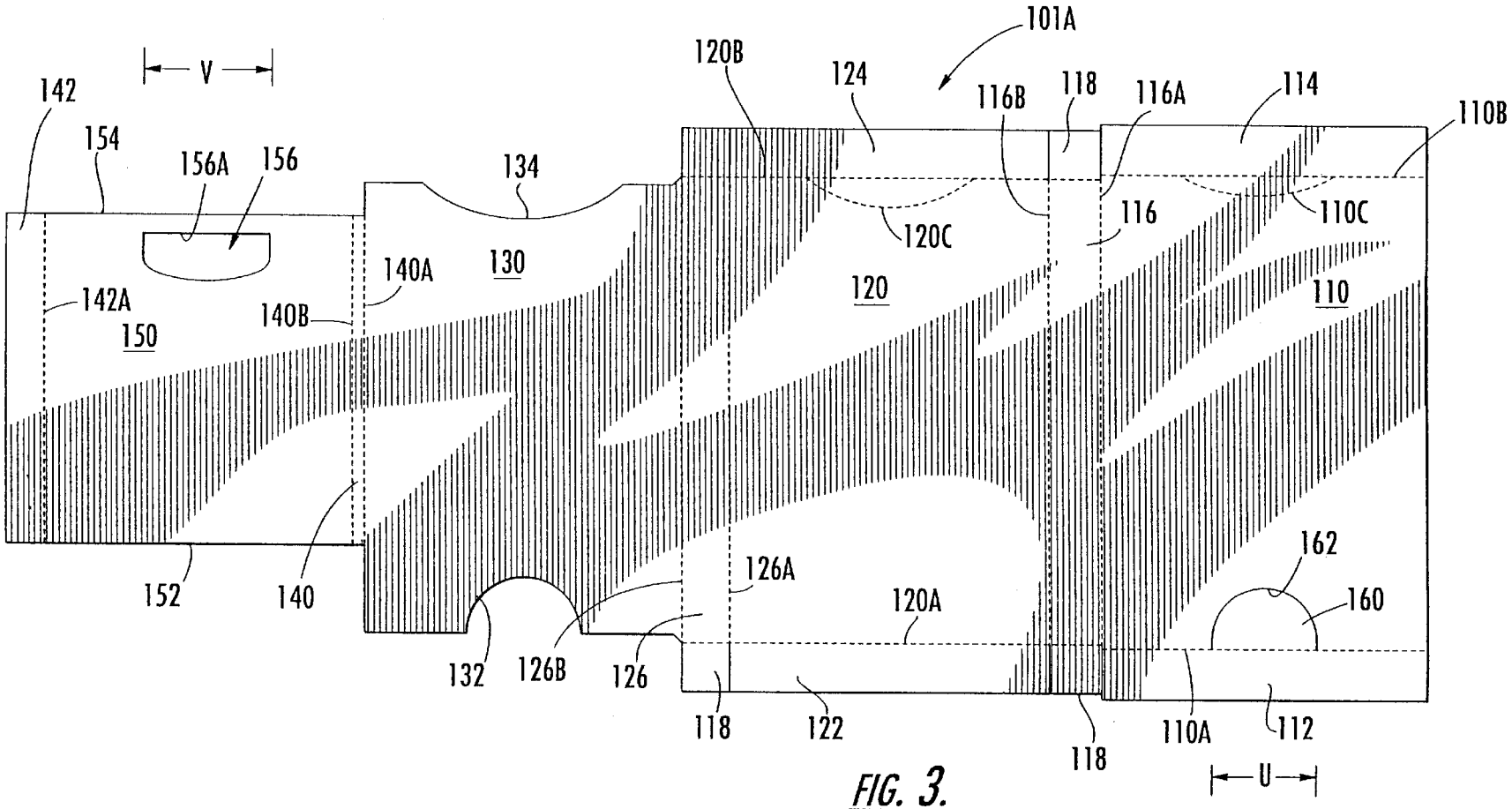
FIG. 3 is a top plan view of a blank for forming the carton of the carton assembly of FIG. 1.

The carton 101 defines an interior cavity 111. The carton 101 may be formed from an integral blank 101A as shown in FIG. 3. The blank 101A may be formed of any suitable material and may be formed from a larger sheet of such material. The blank 101A may be formed using any suitable method or equipment. For example, the blank 101A may be formed by stamping from a sheet. Moreover, a plurality of blanks 101A may be formed from a common sheet. As will be readily apparent from review of FIG. 3, a plurality of the blanks 101A may be efficiently arranged so that the amount of waste material (i.e., material not within the peripheries of the blanks 101A) is relatively small.

Suitable materials for the blank 101A include any flexible sheet material that retains its shape at anticipated usage temperatures (typically, between about −20 and 120° F.). Preferred materials include paperboard, polymeric (e.g., thermoplastic) film and composite paper/foil film. More preferably, the blank 101A is formed of a sheet of paperboard such as solid bleached sulfate (SBS), solid unbleached sulfate (SUS), clay-coated newsback (CCNB) or recycled paperboard. More preferably, the paperboard has a thickness of between about 0.008 and 0.028 inch.

The blank 101A includes a top panel 110, a bottom panel 120 and a subpanel 130. A side panel 116 joins the top panel 110 to the bottom panel 120 along fold lines 116A and 116B. A side panel 126 joins the bottom panel 120 to the subpanel 130 along fold lines 126A and 126B. End panels 112 and 114 are joined to the top panel 110 along fold lines 110A and 110B. End panels 122 and 124 are joined to the bottom panel 120 along fold lines 120A and 120B. End flaps 118 are connected to the side panels 116, 126. The several panels 110, 112, 114, 120, 122, 124, 126 and 130 serve as body panels to form the general framework of the assembled carton 101.

The fold lines 110B, 120B as well as arcuate lines 110C and 120C are weakened, preferably by perforations. Arcuate cut-outs 132 and 134 are formed in the end edges of the subpanel 130. A cut line or perforated line 162 is formed in the top panel 110 and preferably intersects the fold line 110A as shown. The line 162 defines a release tab 160.

A connecting panel 140 is joined to the subpanel 130 along a fold 140A. A locking panel 150 is in turn connected to the connecting panel 140 along a fold 140B. A securing panel 142 is joined to the locking panel 150 along a fold line 142A. The locking panel 150 has a rear edge 152 and an opposing front edge 154. A stop opening 156 is formed in the locking panel 150 (e.g., by punching) and has a front edge 156A.

The carton 101 may be formed from the blank 101A in the following manner. The various folding and gluing steps may be accomplished using any suitable apparatus. For example, the carton 101 may be formed using a Bobst Domino folder/gluer.

The subpanel 130 is folded over the locking panel 150 by folding along each of the fold lines 140A and 140B. In this manner, the connecting panel 140 spaces the adjacent edges of the subpanel 130 and the locking panel 150 from one another. The side panel 126 and the securing panel 142 are each folded down and into engagement with one another as best seen in FIG. 5. A strip of glue 105 is applied to one or both of the side panel 126 and the securing panel 142 so that the panels 126 and 142 are adhered together. The bottom panel 120 is folded under the locking panel 150, the side panel 116 is folded up alongside the connecting panel 140, and the top panel 110 is folded over the subpanel 130. A layer of glue 105 is applied to one or both of the top panel 110 and the subpanel 130 so that the panels 110 and 130 are adhered together. The end flaps 118 are folded in and the end panels 112, 114, 122, 124 are folded over and adhered by glue 105 as best seen in FIG. 4.

Figure 4:
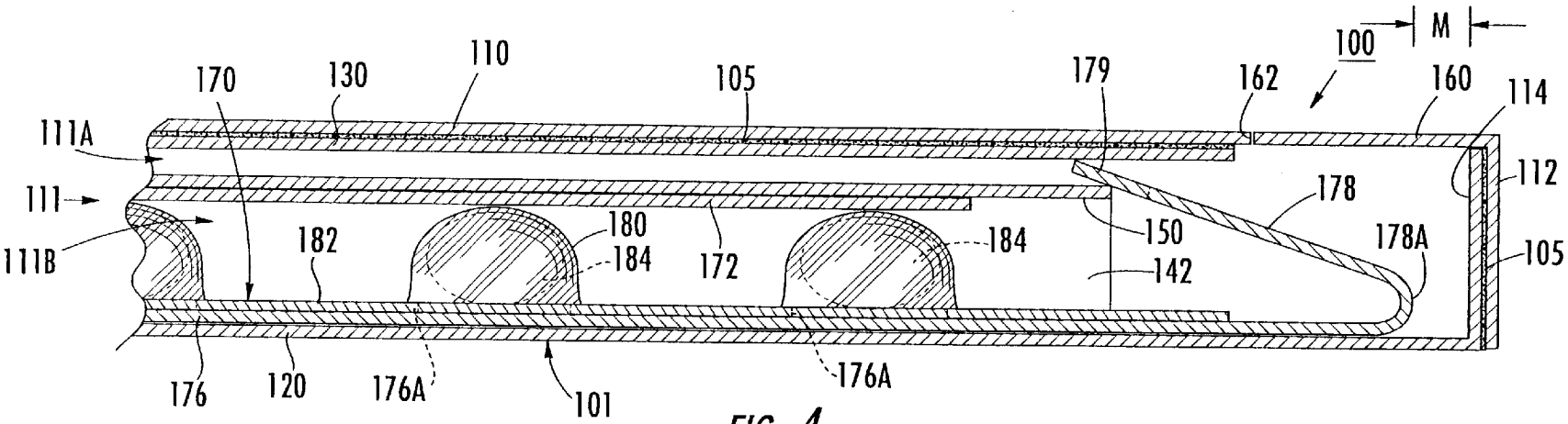
FIG. 4 is a fragmentary, cross-sectional view of the carton assembly of FIG. 1 taken along the line 4—4 of FIG. 1.
Figure 5:
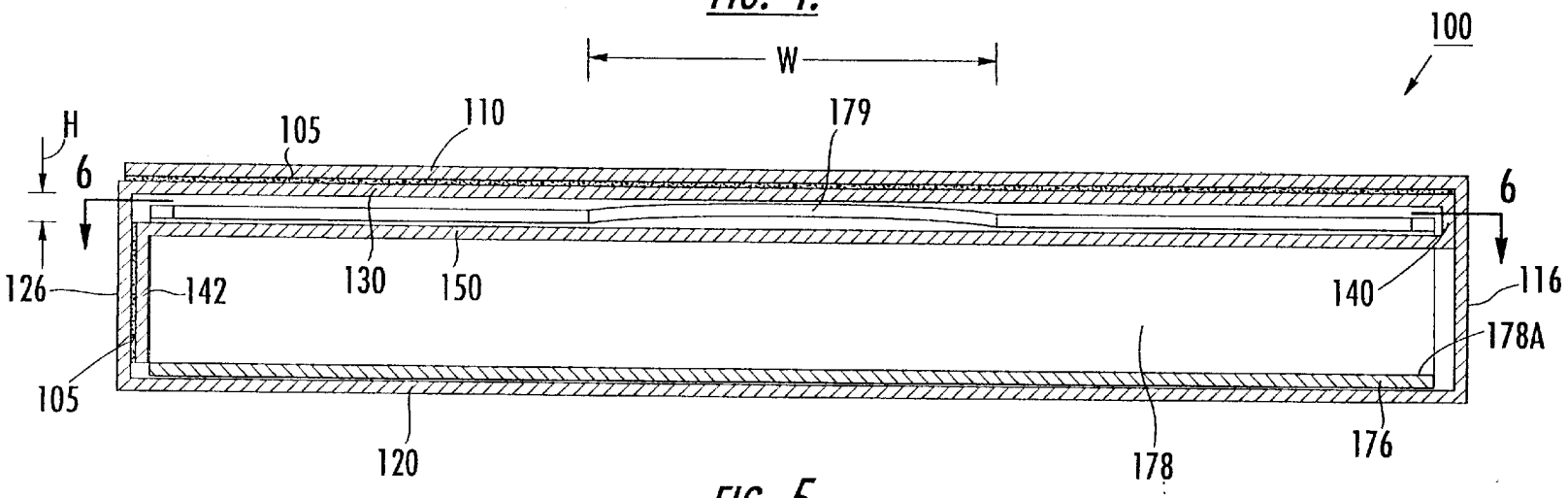
FIG. 5 is a cross-sectional view of the carton assembly of FIG. 1 taken along the line 5—5 of FIG. 1.

As best seen in FIGS. 4 and 5, the locking panel 150 divides the cavity 111 of the carton 101 into an upper chamber 111A and a lower chamber 111B. Preferably, the upper chamber 111A has a height H (i.e., the spacing between the panels 130 and 150; FIG. 5) that is greater than the thickness of a locking flap 178. The height H is more preferably at least 1/16 inch and, most preferably, between about 1/8 inch and 1/4 inch. The locking panel 150 may be substantially uniformly spaced from the subpanel 130 along its entire length. The rear edge 152 and the subpanel 130 form a rear opening 151 (FIG. 8) communicating with the chamber 111A. The opening 115 preferably has the same height as the height H.

The tray 170 may be formed of the same material as described above with regard to the carton 101. The tray 170 may be formed using any suitable method or equipment. The tray 170 has a body portion including a top panel 172, an end panel 174 and a bottom panel 176. The tray 170 further includes the locking flap 178 joined to the bottom panel 176 along a fold 178A. As discussed in greater detail below, the locking flap 178 serves as a releasable locking tab.

A locking projection 179 extends forwardly from the locking flap 178. Preferably, the width W (FIG. 5) of the locking projection 179 is less than the corresponding width of the locking flap 178. The width W of the locking projection 179 is preferably substantially the same as the width U (FIG. 3) of the release tab 160 and between about 3/16 and 1/4 inch less than the width V (FIG. 3) of the stop opening 156. Preferably, the length L (FIG. 6) of the projection 179 is greater than the height H of the upper chamber 111A.

A plurality of holes 176A are formed in the bottom panel 176. A carrier layer 180 (e.g., formed of molded plastic) and a frangible foil layer 182 are adhered to the bottom panel 176. The tray 170 is configured such that pills 184 may be removed from the holes 176A upon tearing the foil 182.

Figure 6:
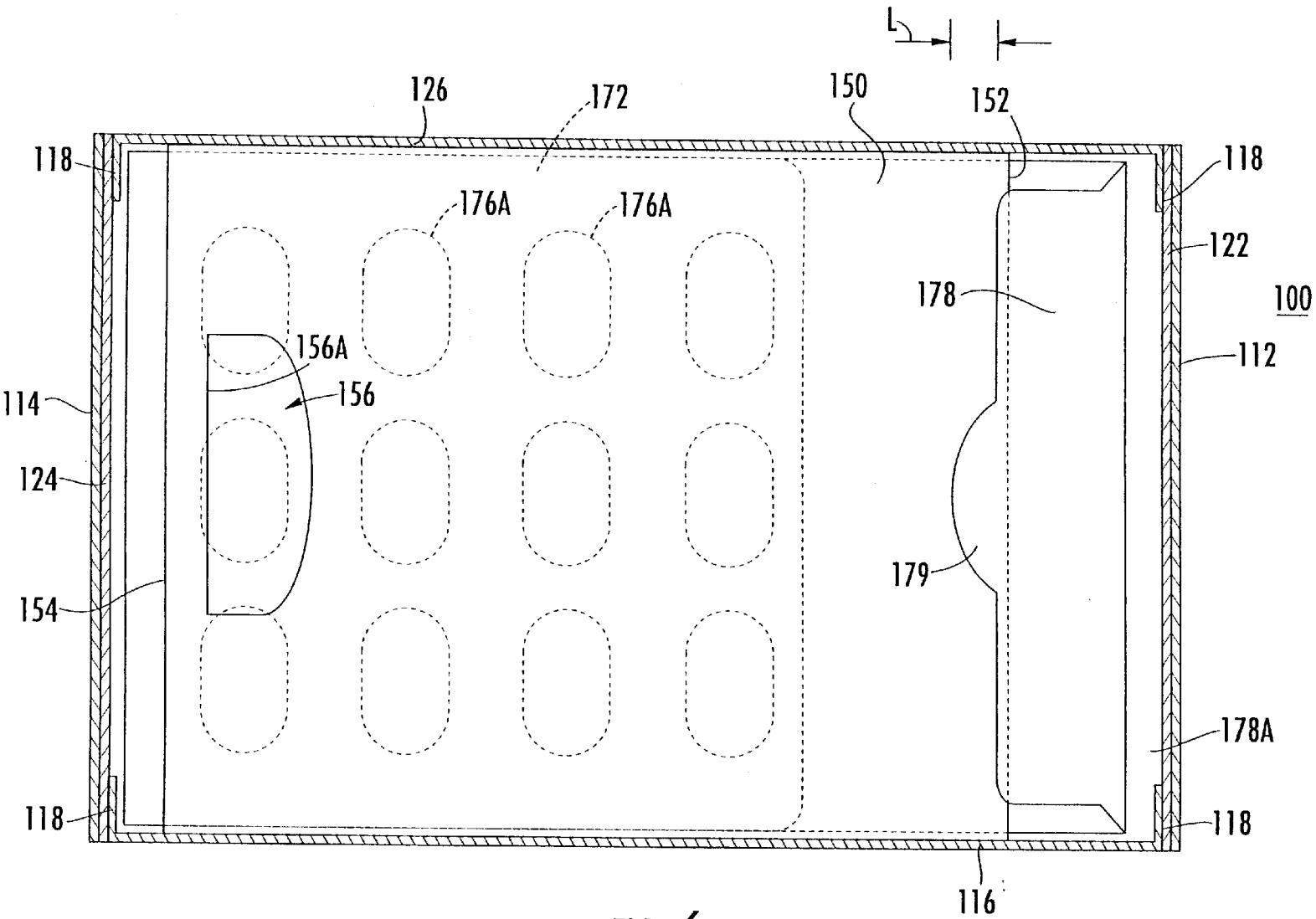
FIG. 6 is a cross-sectional view of the carton assembly of FIG. 1 taken along the line 6—6 of FIG. 5.

The carton assembly 100 may be used in the following manner. FIGS. 4–6 show the assembly 100 in its initial configuration wherein the tray 170 is in a stored position in the carton 110. An insert portion of the locking flap 179 overlaps the rear edge 152 of the locking panel 150 and extends through the opening 151 and into the upper chamber 111A between the locking panel 150 and the subpanel 130. Preferably, the insert portion includes at least the locking projection 179, and more preferably an additional portion of the locking flap 178. The rear edge of the tray 170 as defined by the fold 178A is spaced apart from the end panel 114 at least a distance M (FIG. 4) as discussed below.

The user may tear along the lines 110B and 110C and fold the end panel 114 down as shown in FIG. 2. Alternatively or additionally, the user may tear along the lines 120B and 120C. The user may then grasp the tray 170. Because the locking projection 179 is positioned between the panels 130 and 150, the locking panel 150 prevents the user from further withdrawing the tray 170 from the carton 101.

Figure 7:
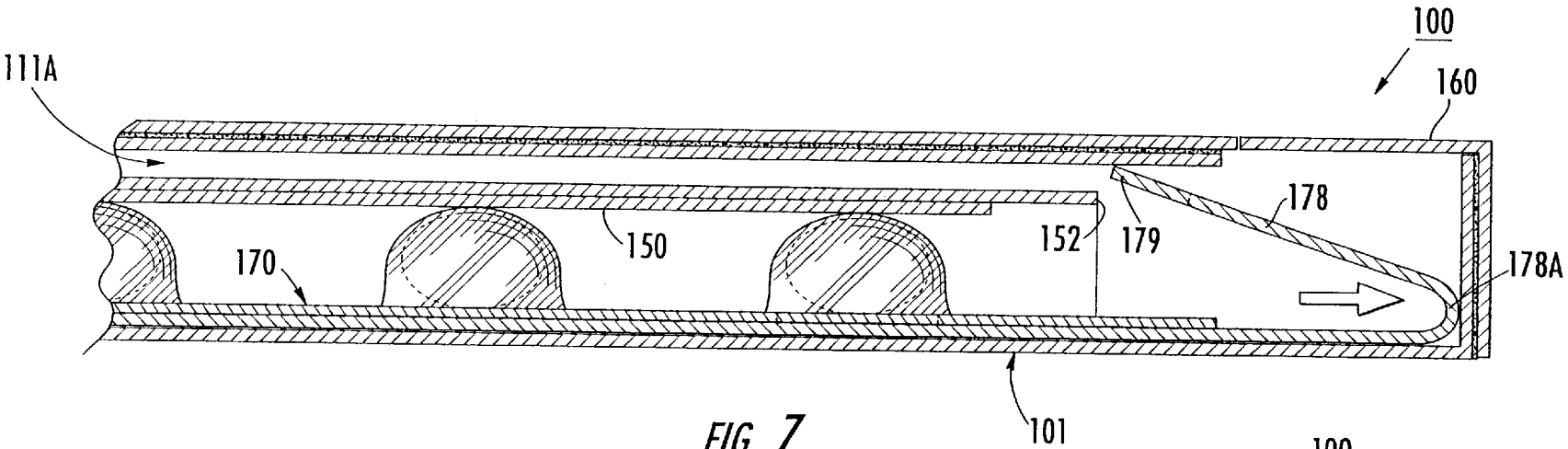
FIG. 7 is a fragmentary, cross-sectional view of the carton assembly of FIG. 1 taken along the line 4—4, but wherein the carton is open and the tray is in a fully inserted position.

The user may push the tray 170 back into the carton 101 as shown in FIG. 7 to disengage the locking projection 179 from the locking panel 150. The tray 170 is pushed back until the locking projection 179 is substantially fully withdrawn through the opening 151 (i.e., the locking projection 179 clears the rear edge 152). Preferably, the tray 170 must be pushed back a distance M (FIG. 4) of at least ¼ inch and, more preferably, between about ¼ and ½ inch. Preferably, as shown, the locking flap 178 does not clear the rear edge of the subpanel 130 when in the rearmost position.

Figure 8:
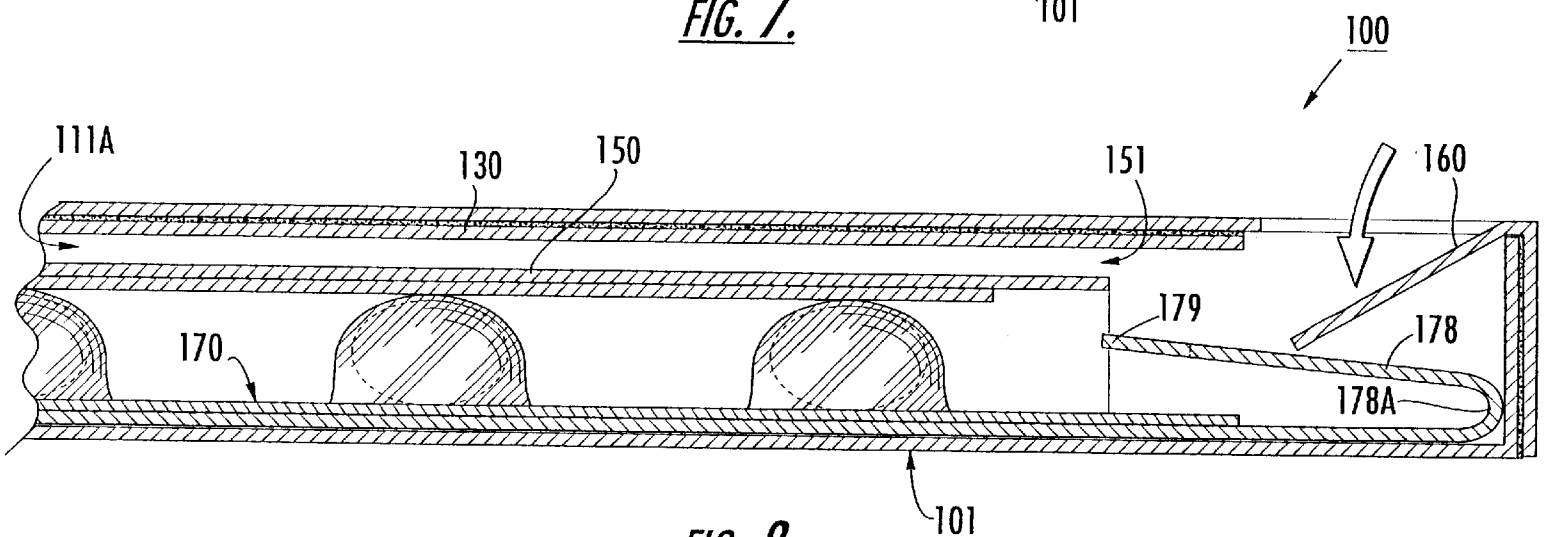
FIG. 8 is a fragmentary, cross-sectional view of the carton assembly of FIG. 1 taken along the line 4—4, but wherein the carton is open and a release tab of the carton assembly is deflected into a releasing position.

The user may then press the release tab 160 such that it separates from the carton 101 along the line 162, hingedly pivots about the fold line 110A and engages the locking flap 178. The release tab 160 thereby deflects the locking flap 178 about the fold 178A as shown in FIG. 8. By holding the locking flap 178 in the deflected position using the release tab 160, the user may pull the tray 170 forwardly out from the carton 101 through the front opening.

Figure 9:
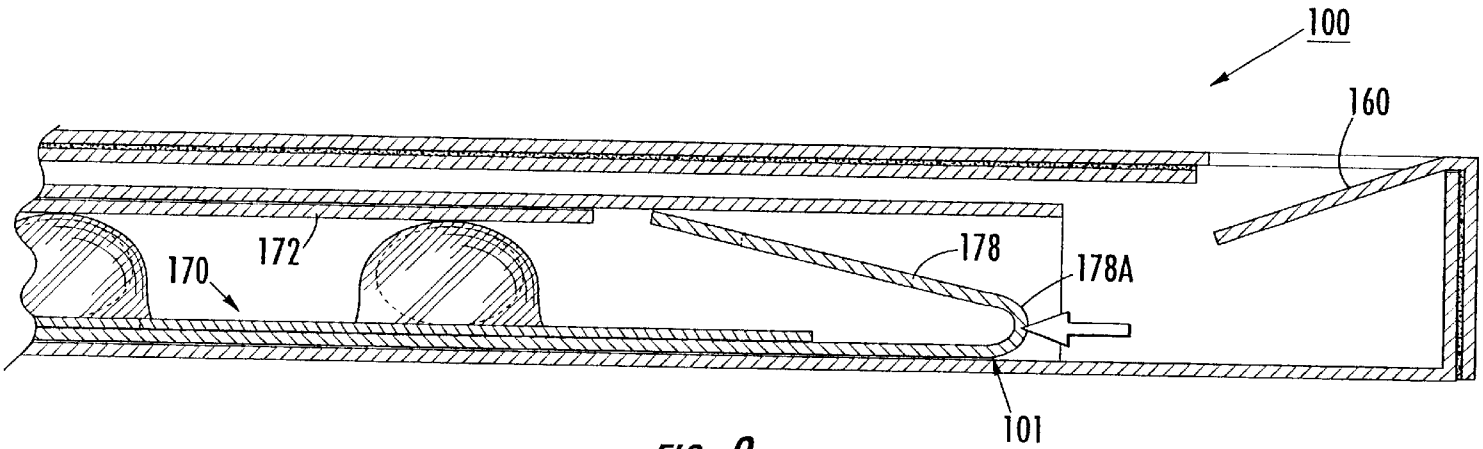
FIG. 9 is a fragmentary, cross-sectional view of the carton assembly of FIG. 1 taken along the line 4—4, but wherein the carton is open and the tray is partially withdrawn.
Figure 10:
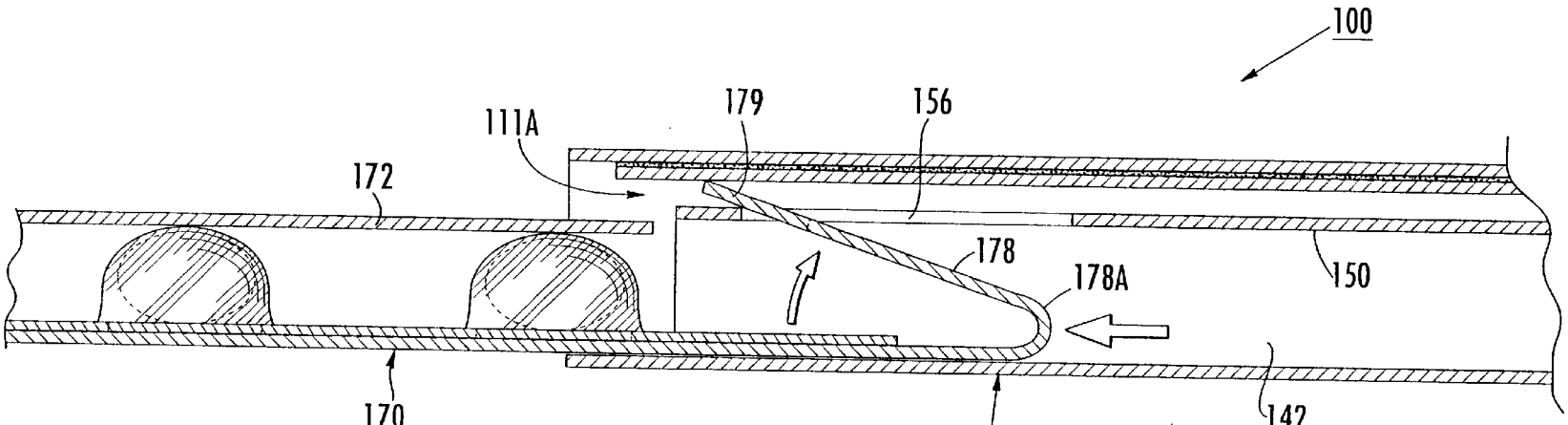
FIG. 10 is a fragmentary, cross-sectional view of the carton assembly of FIG. 1 taken along the line 4—4, but wherein the carton is open and the tray is disposed in a fully extended, limited position.

After the locking projection 179 and the leading edge of the locking flap 178 clear the rear edge 152 of the locking panel 150, the tray 170 may be slid forwardly as shown in FIG. 9 until the locking projection 179 is positioned adjacent the stop opening 156. The locking panel 150 will maintain the locking flap 178 in a partially deflected position as shown and the properties of the material from which the tray 170 is formed will cause the locking flap 178 to be spring biased upwardly against the locking panel 150. Upon reaching the opening 156, the locking flap 178 is permitted to deflect upwardly such that the locking projection 179 extends through the opening 156, over the edge 156A and into the upper chamber 111A between the panels 130 and 150. In this manner, the opening 156 and the locking projection 179 cooperate to limit withdrawal of the tray 170 from the carton 101 to a fully extended position as shown in FIG. 10.

The tray 170 may be returned to the stored position by simply pushing the tray 170 back into the carton 110. Further attempts to withdraw the tray 170 without pressing the release tab 160 will cause a portion of the locking flap 178 to enter the chamber 111A through the opening 151, thereby resisting withdrawal. The tray 170 may again be withdrawn to the fully extended position by repeating the foregoing steps.

Various modifications may be made to the carton assembly 100 as desired. For example, the subpanel 130 may be omitted such that the upper chamber 111A is defined directly between the locking panel 150 and the top panel 110. The carton 101 may be formed from multiple pieces joined together by suitable means such as adhesive. Similarly, the integral panels 172, 174, 176 of the tray 170 may be replaced with multiple, joined pieces. The stop opening 156 may be provided in a further panel spaced apart form the locking panel 150. Preferably, this further panel is also spaced apart from the subpanel.

Figure 11:
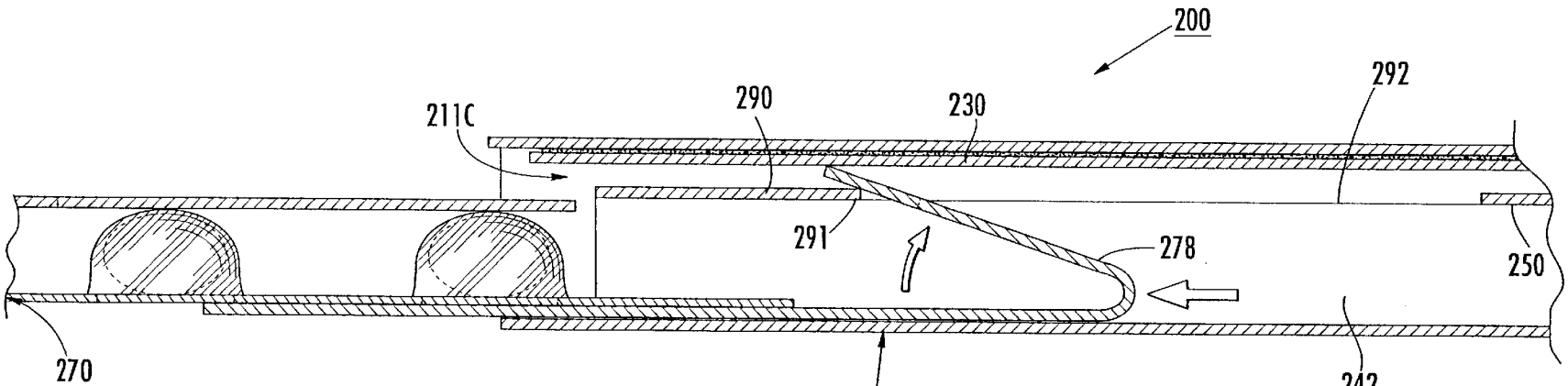
FIG. 11 is a fragmentary, cross-sectional view of a carton assembly according to further embodiments of the present invention taken along a line corresponding to the line 4—4 of FIG. 1.

With reference to FIG. 11, a carton assembly 200 is shown therein including a tray 270 and a carton 201. The tray 270 corresponds to the tray 170 and the carton 201 corresponds to the carton 101, except as follows.

Figure 12:
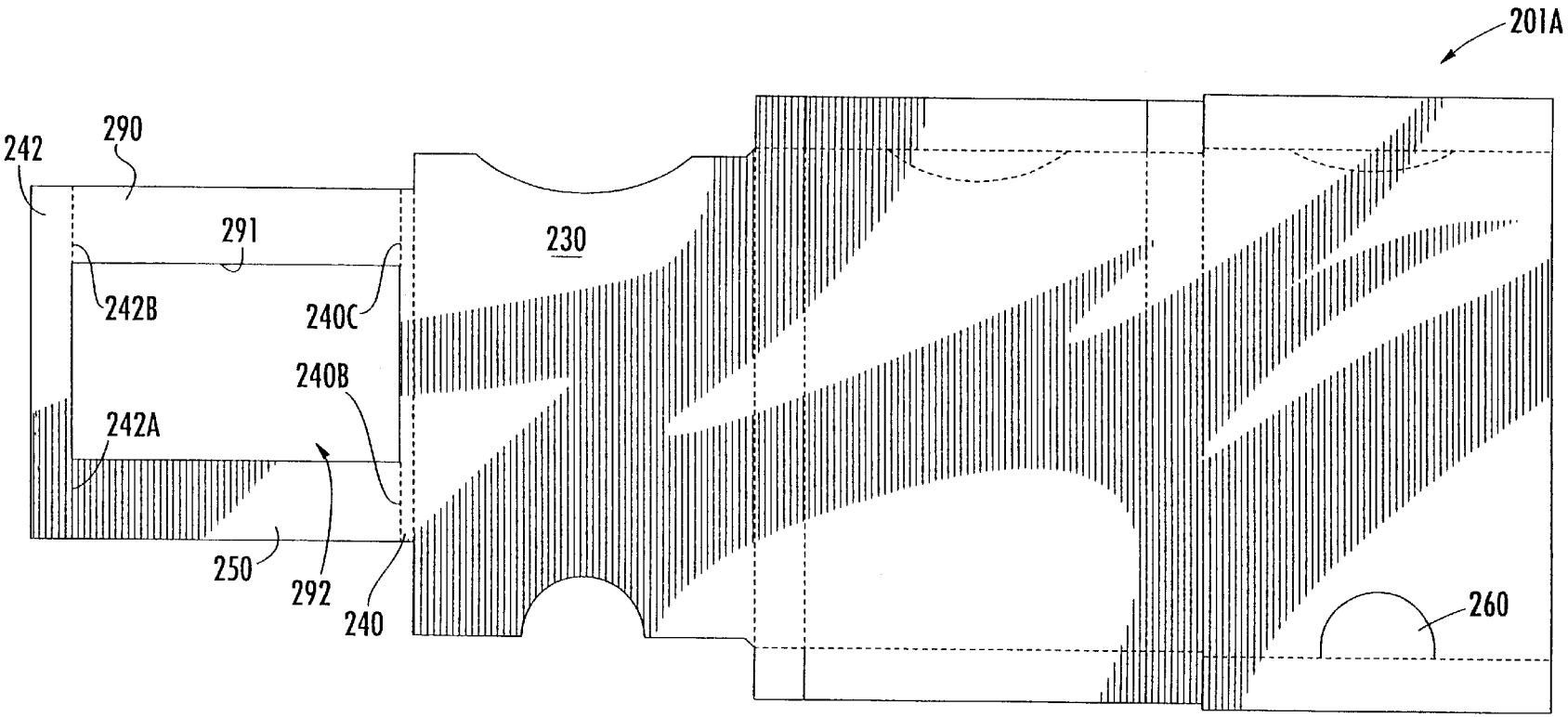
FIG. 12 is a top plan view of a blank for forming a carton of the carton assembly of FIG. 11.

The carton 201 may be formed from a blank 201A as shown in FIG. 12. The blank 201A corresponds to the blank 101A, except that the locking panel 250 is reduced in length and a separate stop panel 290 extends from the connecting panel 240 to the securing panel 242. The locking panel 250, the stop panel 290, the connecting panel 240 and the securing panel 242 define a stop opening 292. The locking panel 250 is joined to the connecting panel 240 along a fold line 240B, and is joined to the securing panel 242 along a fold line 242A. The stop panel is joined to the connecting panel 240 along a fold line 240C, and is joined to the securing panel 242 along a fold line 242B. The carton 201 may be formed from the blank 201A by gluing and folding in the same manner as described above with respect to the blank 101A and the carton 101.

The locking flap 278 (FIG. 11) cooperates with the release tab 260 and the locking panel 240 in the same manner as described above with regard to the carton assembly 100, to releasably and relockably secure the tray 270 in the stored position. When the tray 270 is released and pulled forwardly, the locking flap 278 will slide into a chamber 211C defined between the stop panel 290 and the subpanel 230 such that the locking flap 278 overlaps the rear edge 291 of the stop panel 290. In this manner, removal of the tray 270 from the carton 201 is limited.

Figure 13:
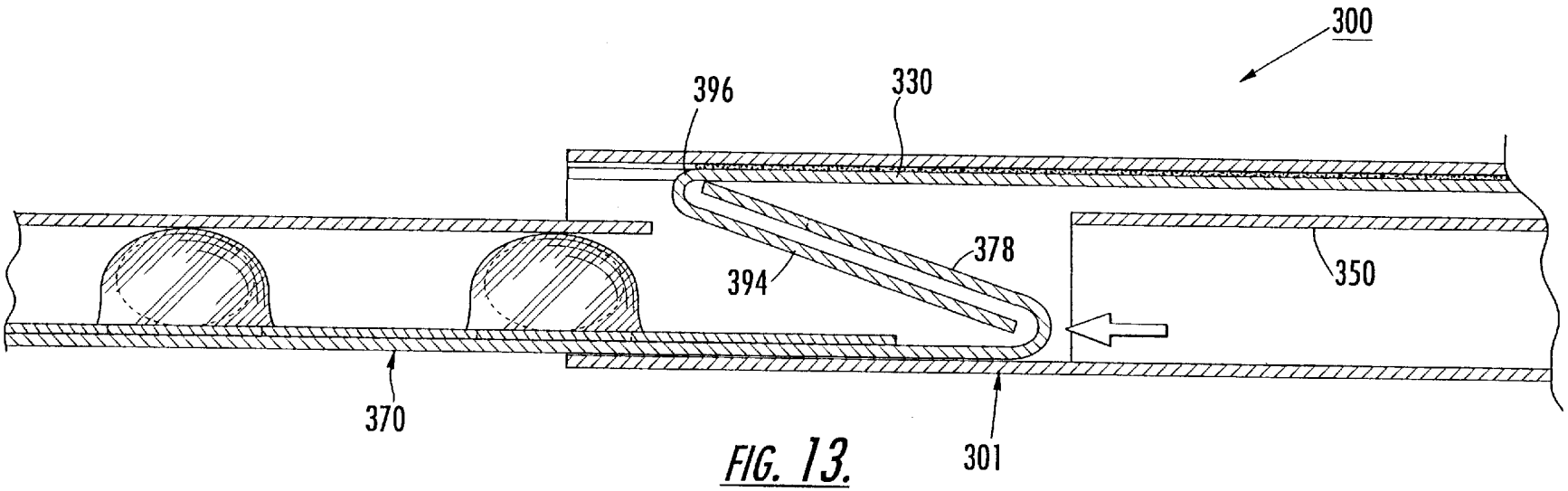
FIG. 13 is a fragmentary, cross-sectional view of a carton assembly according to further embodiments of the present invention taken along a line corresponding to the line 4—4 of FIG. 1.

With reference to FIG. 13, a carton assembly 300 is shown therein including a tray 370 and a carton 301. The tray 370 corresponds to the tray 170 and the carton 301 corresponds to the carton 101, except as follows.

Figure 14:
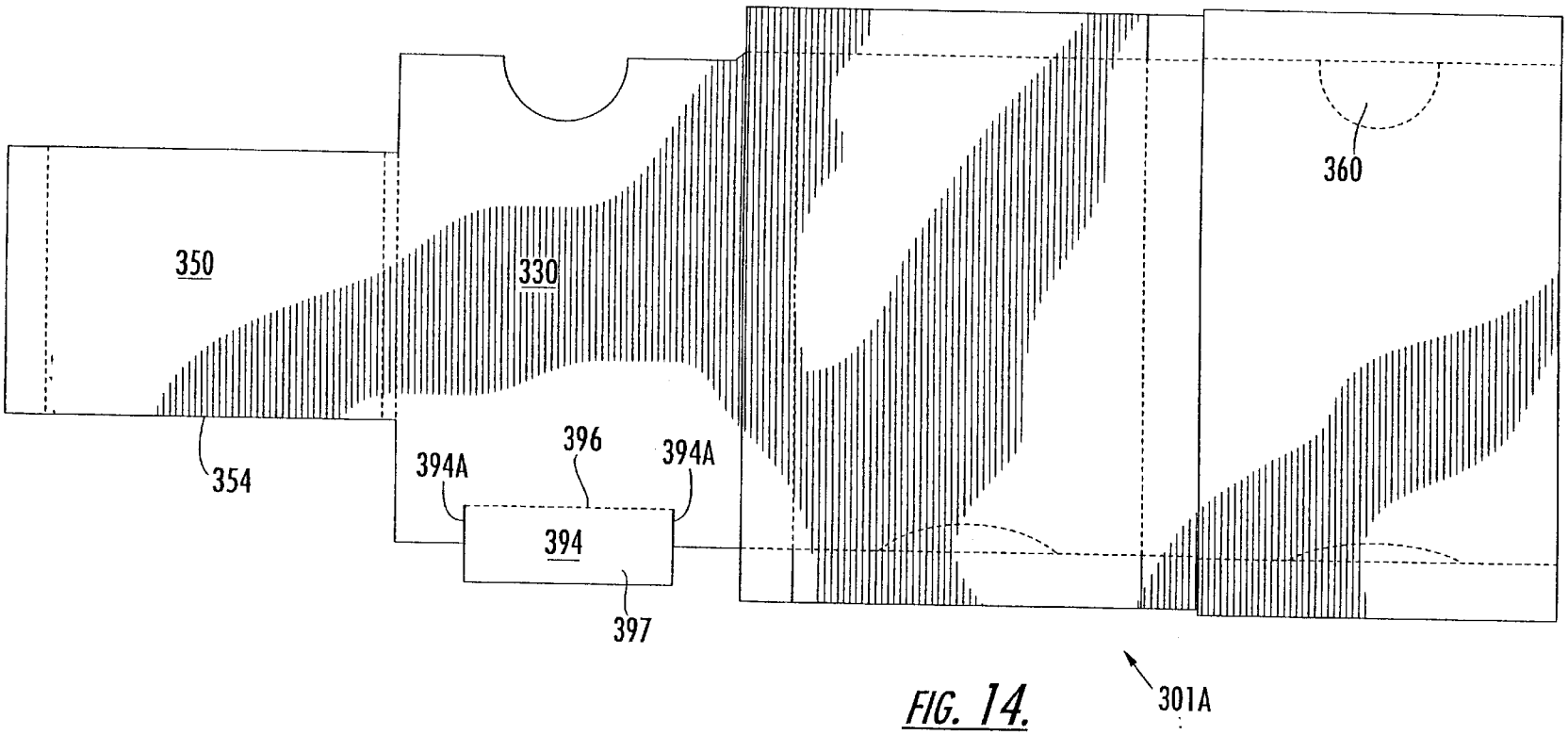
FIG. 14 is a top plan view of a blank for forming a carton of the carton assembly of FIG. 13.

The carton 301 may be formed from a blank 301A, as shown in FIG. 14. The blank 301A corresponds to the blank 101A, except as follows. The front edge 354 of the locking panel 350 is set back from the front edge of the subpanel 330 by an increased distance. A stop flap 394 is formed, in part, by cut lines 394A in the subpanel 330 and a portion 397 extending forwardly beyond the front edge of the subpanel 330. The stop flap 394 is connected to the subpanel 330 by a fold line 396. The carton 301 may be assembled in the same manner by folding and gluing as described above with regard to assembly of the carton 301, except that the stop flap 394 is folded downwardly and rearwardly into the carton 301 (i.e., toward the rear end of the carton 301).

In use, the locking flap 378 cooperates with the release tab 360 and the locking panel 350 in the same manner as described above, to releasably and relockably secure the tray 370 in the stored position. When the tray 370 is released and pulled forward, the locking flap 378 will slide between the stop panel 394 and the subpanel 330 in interlocking manner. In this manner, removal of the tray 370 from the carton 301 is limited.

The carton assemblies 100, 200, 300 may be modified to include one or more relatively rigid components. For example, the cartons 101, 201, 301 may be formed of a stiff plastic or metal with the release tabs 160, 260, 360 being hingedly connected to the remainder of the carton, for example, by a live hinge. Similarly, the trays 170, 270, 370 may be formed of a stiff material with the locking flaps 178, 278, 378 being hingedly connected to the bottom tray panels (e.g., the panel 176) such as by a live hinge.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A child resistant carton assembly comprising:

a) a carton defining an interior cavity and including:

1) first and second opposed body panels;

2) a locking panel disposed in said interior cavity and interposed between and spaced apart from each of said first and second body panels, wherein said locking panel and said first body panel define a locking chamber therebetween and said locking panel and said second body panel define a second chamber therebetween; and b) a tray slidably mounted in said carton, said tray including a locking tab adapted to releasably engage said locking panel such that at least an insert portion of said locking tab is disposed in said locking chamber.

2. The carton assembly of claim 1 wherein said locking panel is spaced apart from said first body panel along substantially the entire length of said locking panel.

3. The carton assembly of claim 1 wherein said locking panel is spaced apart from said first body panel a distance of at least 1/16 inch.

4. The carton assembly of claim 3 wherein said locking panel is spaced apart from said first body panel a distance of between about 1/8 and 1/4 inch.

5. The carton assembly of claim 1 including a release tab operable to displace said locking tab to disengage said locking tab from said locking panel.

6. The carton assembly of claim 1 wherein said carton is formed of at least one material selected from the group consisting of paperboard, polymeric film and composition paper/foil film.

7. The carton assembly of claim 1 wherein said tray is formed of at least one material selected from the group consisting of paperboard, polymeric film and composition paper/foil film.

8. The carton assembly of claim 1 including an end panel adjacent said locking tab and wherein said locking panel has an end edge adjacent and spaced apart from said end panel.

9. The carton assembly of claim 1 wherein:

said tray includes a body portion slidably mounted in said second chamber; and said locking tab is connected to said body portion.

10. The carton assembly of claim 9 including a locking flap adjoining said body portion along a fold and wherein said locking tab forms at least a part of said locking flap.

11. The carton assembly of claim 1 wherein said locking tab includes a projection having a smaller width than a remaining portion of said locking tab.

12. The carton assembly of claim 1 including a stop opening adapted to engage said locking tab to limit withdrawal of said tray from said carton.

13. The carton assembly of claim 12 wherein said stop opening is formed in said locking panel.

14. The carton assembly of claim 12 wherein said stop opening is spaced apart from said first body panel.

15. A method for using a child resistant carton including a carton and a tray slidably mounted in the carton, the carton including first and second opposed body panels and a locking panel interposed between and spaced apart from each of the first and second body panels, the locking panel and the first body panel defining a locking chamber therebetween and the locking panel and the second body panel defining a second chamber therebetween, the tray including a locking tab, said method comprising the steps of:

inserting at least an insert portion of the locking tab into the locking chamber to resist withdrawal of the tray from the carton; and displacing the locking tab from the locking chamber to release the tray.

16. The method of claim 15 wherein said step of displacing the locking tab includes pressing a release tab forming a part of the carton such that the release tab displaces the locking tab.

17. The method of claim 15 including the step of withdrawing the tray from the carton until at least a portion of the locking tab engages a stop opening.

18. The method of claim 17 including the step of re-inserting the tray into the carton such that the insert portion is again disposed in the locking chamber to resist withdrawal of the tray from the carton.

19. The method of claim 15 including sliding a body portion of the tray within the second chamber, wherein the locking tab is connected to the body portion.

* * * * *